US011644772B2

(12) United States Patent
Eiki et al.

(10) Patent No.: US 11,644,772 B2
(45) Date of Patent: May 9, 2023

(54) IMAGE FORMING APPARATUS

(71) Applicant: KYOCERA Document Solutions Inc., Osaka (JP)

(72) Inventors: Takashi Eiki, Osaka (JP); Akihiro Kondo, Osaka (JP); Ryohei Tokunaga, Osaka (JP); Yuta Kitabayashi, Osaka (JP); Hiroki Kawasaki, Osaka (JP); Shunsaku Fujii, Osaka (JP); Tei To, Osaka (JP); Rina Kikugawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/680,755

(22) Filed: Feb. 25, 2022

(65) Prior Publication Data

US 2022/0276591 A1 Sep. 1, 2022

(30) Foreign Application Priority Data

Feb. 26, 2021 (JP) ..... JP2021-030768

(51) Int. Cl.
*G03G 15/20* (2006.01)
*G03G 15/00* (2006.01)

(52) U.S. Cl.
CPC ..... *G03G 15/205* (2013.01); *G03G 15/2064* (2013.01); *G03G 15/5045* (2013.01)

(58) Field of Classification Search
None
See application file for complete search history.

(56) References Cited

U.S. PATENT DOCUMENTS 5,745,247 A * 4/1998 Yasui ..... H04N 1/32486 399/83
8,873,984 B2 * 10/2014 Ishii ..... G03G 15/205 399/329
2011/0150518 A1 * 6/2011 Hase ..... G03G 15/2039 399/70
2016/0116875 A1 * 4/2016 Hazeyama ..... G03G 15/2028 399/67
2019/0079436 A1 * 3/2019 Ohnishi ..... G03G 15/2028
2020/0233343 A1 * 7/2020 Hisada ..... G03G 15/205
2021/0397115 A1 * 12/2021 Yabuki ..... G03G 15/2064
2022/0043374 A1 * 2/2022 Otsuka ..... G03G 15/2039

FOREIGN PATENT DOCUMENTS

JP 2010061101 A * 3/2010 ..... G03G 15/2032
JP 2018-137054 A 8/2018

* cited by examiner

*Primary Examiner* — Sevan A Aydin
(74) *Attorney, Agent, or Firm* — Studebaker & Brackett PC

(57) ABSTRACT

A duration measuring section measures a plurality of times. A temperature measuring section measures a temperature of a heater at each of the times. A temperature information outputting section outputs heater temperature information. A temperature tendency computing section outputs temperature tendency information of the heater. A drive controller outputs linear velocity information for controlling the linear velocity of a pressure roller. A pressure roller drive section drives the pressure roller.

4 Claims, 8 Drawing Sheets

| | Gradient | Correction amount |
|---|---|---|
| Tendency A | −20 | 0 |
| Tendency B | −15 | −5 |
| Tendency C | −10 | −10 |

| | Gradient | Correction amount |
|---|---|---|
| Tendency D | 10 | 0 |
| Tendency E | 15 | −5 |
| Tendency F | 20 | −10 |

IMAGE FORMING APPARATUS

INCORPORATION BY REFERENCE

The present application claims priority under 35 U.S.C. § 119 to Japanese Patent Application No. 2021-030768, filed on Feb. 26, 2021. The contents of this application are incorporated herein by reference in their entirety.

BACKGROUND

The present disclosure relates to an image forming apparatus.

There is a technique that copes with an excessive increase in temperature of a fixing device upon out of control of a heating body due to thermistor failure.

SUMMARY

An image forming apparatus according to an aspect of the present disclosure includes a fixing device. The fixing device includes a fixing belt, a heater, and a pressure roller. The fixing belt heats a toner image transferred to a sheet to fix the toner image to the sheet. The heater heats the fixing belt. The pressure roller rotates the fixing belt while in contact with the fixing belt. The image forming apparatus further includes a duration measuring section, a temperature measurement section, a temperature information output section, a temperature tendency computing section, a drive controller, and a pressure roller drive section. The duration measuring section measures a plurality of time durations. The temperature measuring section measures a temperature of the heater at each of the times or measure a temperature of the fixing belt at each of the times. The temperature information output section outputs heater temperature information based on the temperatures of the heater at the respective times or output fixing belt temperature information based on the temperatures of the fixing belt at the respective times. The temperature tendency computing section outputs temperature tendency information of the heater based on the heater temperature information or output temperature tendency information of the fixing belt based on the fixing belt temperature information. The drive controller outputs linear velocity information for controlling a linear velocity of the pressure roller based on the temperature tendency information of the heater or the temperature tendency information of the fixing belt. The pressure roller drive section drives the pressure roller based on the linear velocity information.

DETAILED DESCRIPTION

Figure 1:
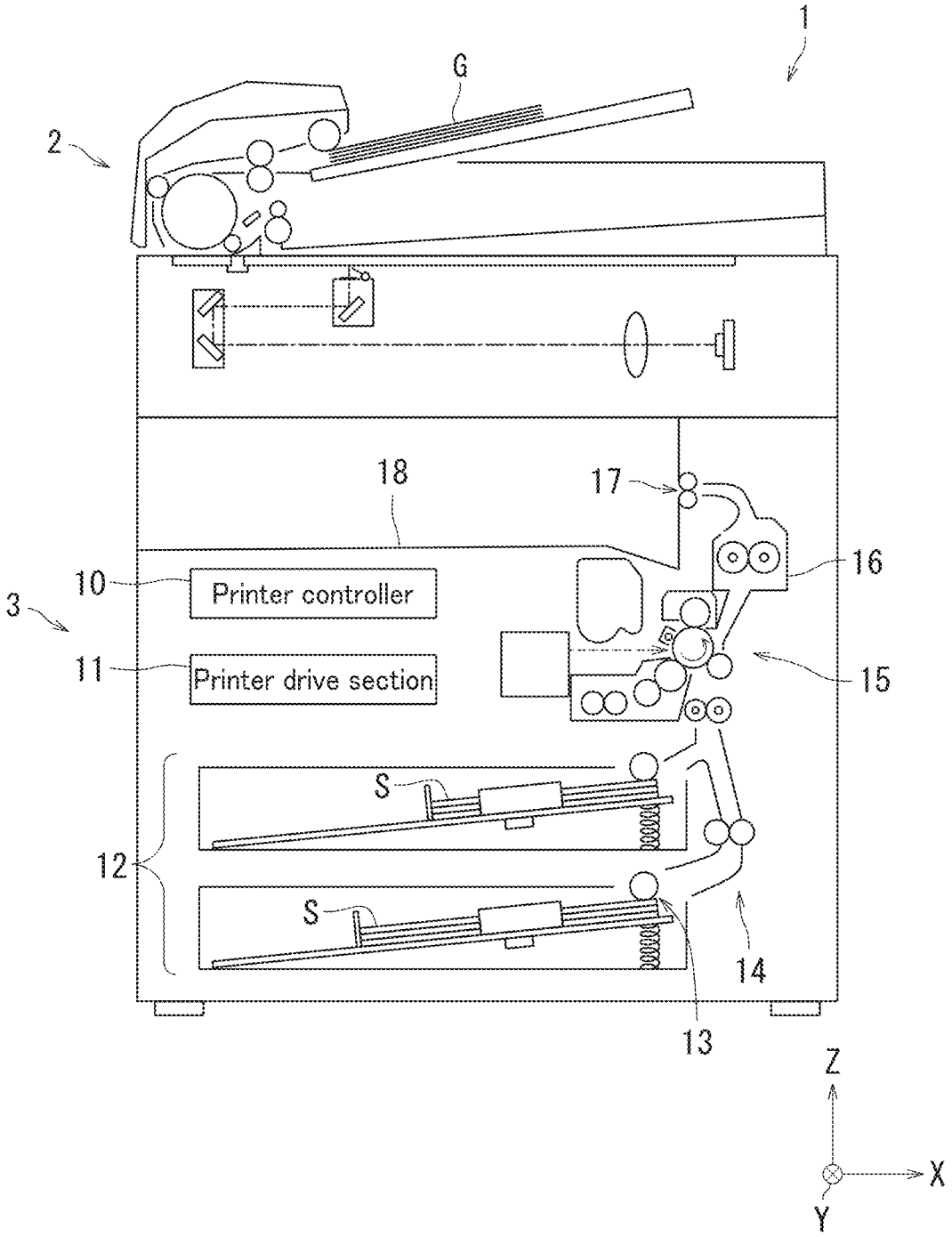
FIG. 1 is a diagram illustrating a multifunction peripheral including an image forming apparatus according to an embodiment of the present disclosure.

The following describes an embodiment of the present disclosure with reference to the accompanying drawings. Note that elements that are the same or equivalent are indicated by the same reference signs in the drawings and description thereof is not repeated. In the drawings, an X axis, a Y axis, and a Z axis that are perpendicular to one another are indicated as appropriate. The Z axis is parallel to the vertical direction, and the X axis and the Y axis are parallel to a horizontal plane.

The Z-axis direction may be referred to as "sub-scanning direction" in the present embodiment. Also, the Y-axis direction may be referred to as "main scanning direction". The X-axis direction may be referred to as "direction perpendicular to the main scanning direction and the sub-scanning direction".

Figure 2:
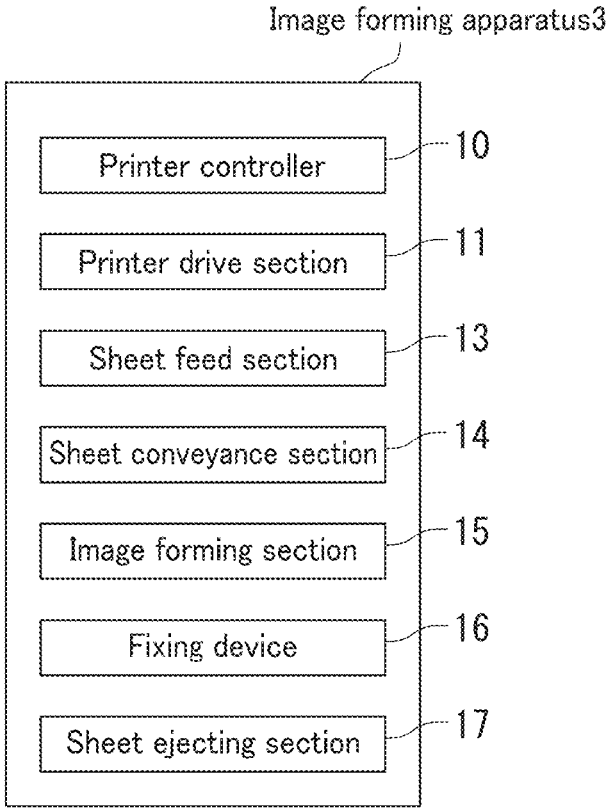
FIG. 2 is a block diagram of a configuration of the image forming apparatus according to the embodiment.

The configuration of a multifunction peripheral 1 will be described with reference to FIG. 1. FIG. 1 is a diagram illustrating the multifunction peripheral 1 including a fixing device 16 according to the present embodiment. The configuration of an image forming apparatus 3 including the fixing device 16 in the present embodiment will be also described with reference to FIG. 2. FIG. 2 is a block diagram of the configuration of the image forming apparatus 3 including the fixing device 16 in the present embodiment.

As illustrated in FIG. 1, the multifunction peripheral 1 includes a document reading device 2 and an image forming apparatus 3. The multifunction peripheral 1 has functions of a scanner, a copier, a printer, and a facsimile machine, and an additional function, for example.

The document reading device 2 includes a document feed tray, a document feed section, a document conveyance section, a document reading section, an optical member, a document ejecting section, and a document exit tray, for example.

The image forming apparatus 3 includes a printer controller 10, a printer drive section 11, sheet trays 12, sheet feed sections 13, a sheet conveyance section 14, an image forming section 15, a fixing device 16, a sheet ejecting section 17, and a sheet exit tray 18.

The printer controller 10 controls operation of each element of the image forming apparatus 3. The printer controller 10 may function as a controller that controls operation of each element of the multifunction peripheral 1. Specific examples of the printer controller 10 includes a central processing unit (CPU), a micro-processing unit (MPU), and an application specific integrated circuit (ASIC).

The printer drive section 11 drives each element of the image forming apparatus 3. The printer drive section 11 may be a drive section that drives each element of the multifunction peripheral 1. Specific examples of the printer drive section 11 include an electric motor, an electromagnetic solenoid, a hydraulic cylinder, and a pneumatic cylinder.

Sheets S are stacked on each sheet tray 12. The sheets S each are an example of a recording medium. The sheet tray 12 may include a tray and a lifting member. The sheet feed sections 13 each picks up the sheets S stacked on the sheet tray 12 one at a time for feeding. Each of the sheet feed sections 13 is a pickup roller, for example.

The sheet conveyance section 14 conveys each sheet S fed from the sheet tray 12. The sheet conveyance section 14 forms a conveyance path. The conveyance path extends from each sheet tray 12 as a starting point to the sheet ejecting section 17 via the image forming section 15 and the fixing device 16. The sheet conveyance section 14 may include conveyance rollers and a registration roller along the conveyance path.

The conveyance rollers may be disposed along the conveyance path to convey the sheet S. The registration roller adjusts timing of conveyance of the sheet S to the image forming section 15. The sheet conveyance section 14 conveys the sheet S from the sheet tray 12 to the sheet ejecting section 17 via the image forming section 15 and the fixing device 16.

The image forming section 15 electrographically forms a non-illustrated toner image on the sheet S based on document image data. The document image data represents an image of a document G, for example.

The fixing device 16 applies heat and pressure to the toner image developed on the sheet S to fix the toner image to the sheet S.

The sheet ejecting section 17 ejects the sheet S out of the casing of the multifunction peripheral 1 (image forming apparatus 3). The sheet ejecting section 17 is an ejection roller, for example.

The sheets S ejected by the sheet ejecting section 17 are stacked on the sheet exit tray 18.

Figure 3:
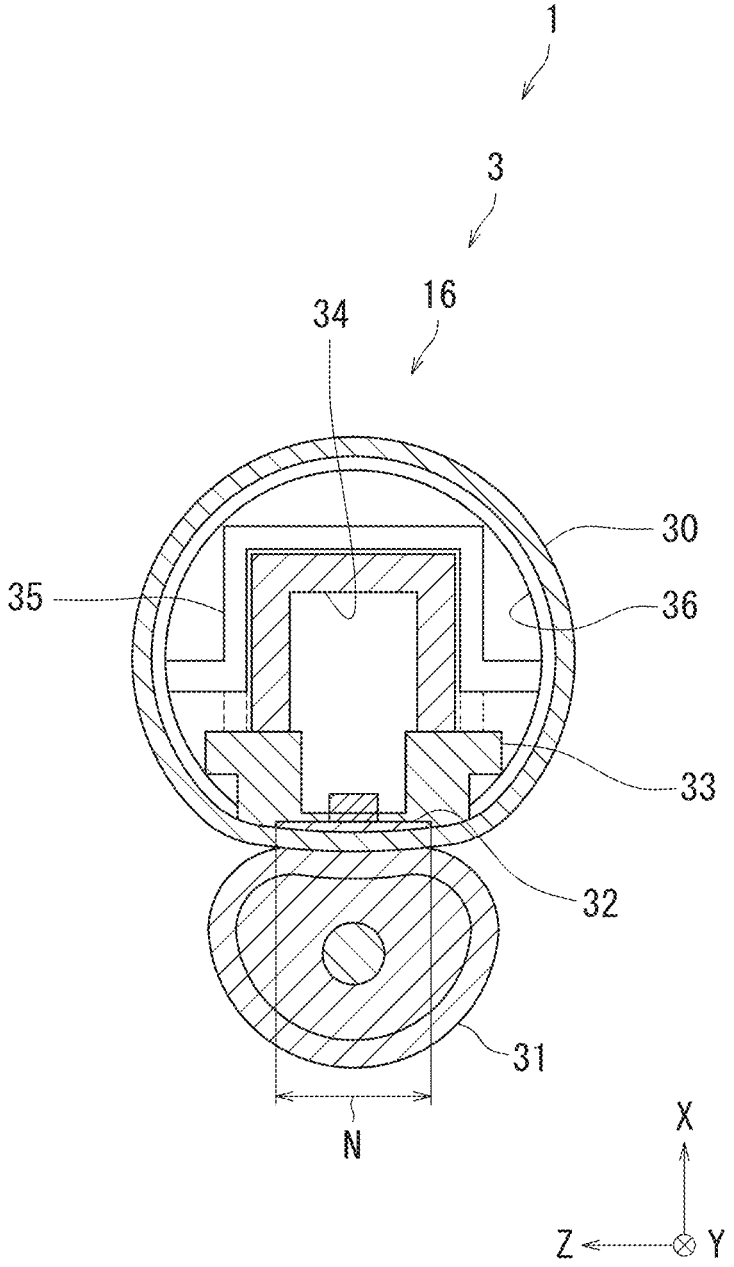
FIG. 3 is a cross-sectional view of a configuration of a fixing device included in the image forming apparatus according to the embodiment.

The configuration of the fixing device 16 in the present embodiment will be described next in detail with reference to FIG. 3. FIG. 3 is a cross-sectional view of the configuration of the fixing device 16 in the present embodiment.

As illustrated in FIG. 3, the fixing device 16 includes a fixing belt 30, a pressure member 31, a heater 32, a heater holding member 33, a frame stay metal plate 34, a frame stay metal plate holder 35, and a fixing belt holder 36.

The fixing belt 30 heats the sheet S (FIG. 1), to which the toner image formed in the image forming section 15 illustrated in FIG. 1 has been transferred and which has been conveyed to the fixing device 16, to fix the toner image to the sheet S.

The fixing belt 30 illustrated in FIG. 3 is an endless belt. The fixing belt 30 has a substantially cylindrical shape. The fixing belt 30 is flexible.

The fixing belt 30 includes a plurality of layers. For example, the fixing belt 30 includes a polyimide layer containing polyimide, an elastic layer containing an elastic material such as silicone rubber, and a release layer. The release layer serves as an outermost layer formed on the outer circumferential surface of the polyimide layer. The release layer is a heat resistant film made from fluororesin, for example.

The pressure member 31 is rotationally driven while being pressed against (in contact with) the fixing belt 30 to rotationally drive the fixing belt 30. The pressure member 31 has a substantially columnar shape, and is disposed opposite to the fixing belt 30. The pressure member 31 is a pressure roller, for example. In the following, the pressure member 31 may be referred to as "pressure roller 31".

The pressure roller 31 includes a columnar metal core, a cylindrical elastic layer, and a release layer. The elastic layer is formed on the metal core. The release layer is formed to cover the surface of the elastic layer.

The metal core is made from stainless steel or aluminum, for example. The elastic layer is elastic and is made from for example silicone rubber. The release layer is made from fluororesin, for example.

The heater 32 is connected to a non-illustrated power source and generates heat. The heater 32 heats the fixing belt 30. The heater 32 is disposed opposite to the inner circumferential surface of the fixing belt 30.

The heater 32 is a surface heater or a heater with a thin and narrow plate shape, for example. For example, the heater 32 is a ceramic heater and includes a ceramic substrate and a resistive heating element. The heater 32 has a thickness of 1 mm, for example. The heater 32 receives pressure from the pressure roller 31 via the fixing belt 30.

As a result of the pressure roller 31 being pressed to the fixing belt 30, a nip part N is formed at a contact part between the fixing belt 30 and the pressure roller 31. As a result of the pressure roller 31 being pressed to the fixing belt 30, the heater 32 is pressed against the inner circumferential surface of the fixing belt 30. As such, the fixing belt 30 is heated by the heater 32 to fix the toner image formed on the sheet S (FIG. 1) to the sheet S when the sheet S passes through the nip part N.

The heater holding member 33 guides the fixing belt 30 in a rotatable manner, and holds the heater 32 that heats the fixing belt 30.

The frame stay metal plate 34 reinforces the heater holding member 33. The frame stay metal plate 34 is a metal-made slender frame stay member. The frame stay metal plate 34 may have an angular U shape, a U shape, or a V shape.

The frame stay metal plate holder 35 holds the frame stay metal plate 34 so as to fix the frame stay metal plate 34 to the heater holding member 33.

The fixing belt holder 36 guides the fixing belt 30 in a rotatable manner.

Figure 4:
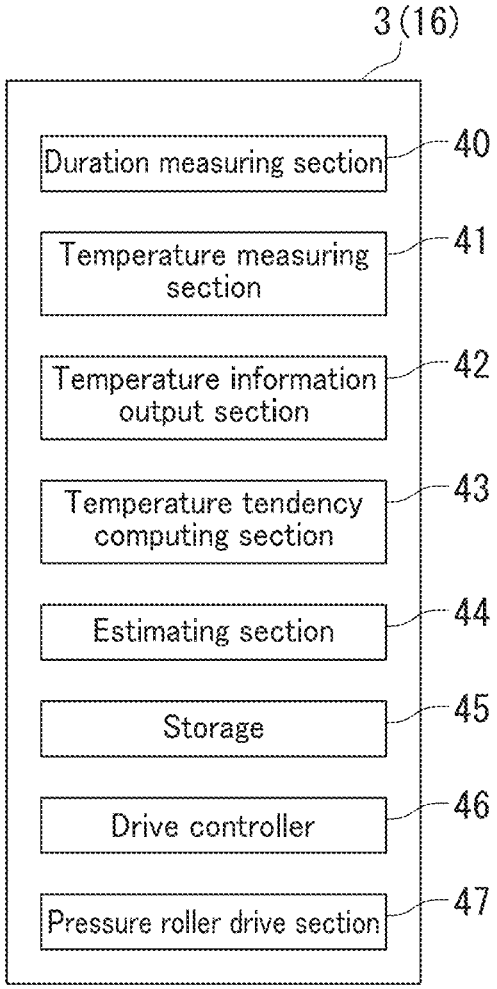
FIG. 4 is a block diagram of elements for temperature control in the fixing device.
Figures 5A, 5B:
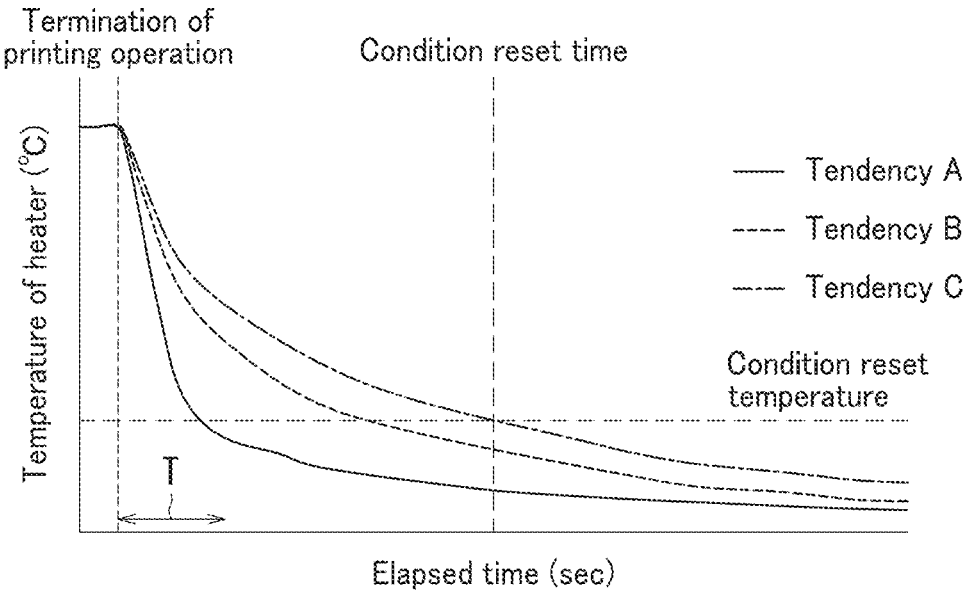
FIGS. 5A and 5B illustrate linear velocity control on a pressure roller based on temperature change of a heater after the fixing device stops working.
Figures 6A, 6B:
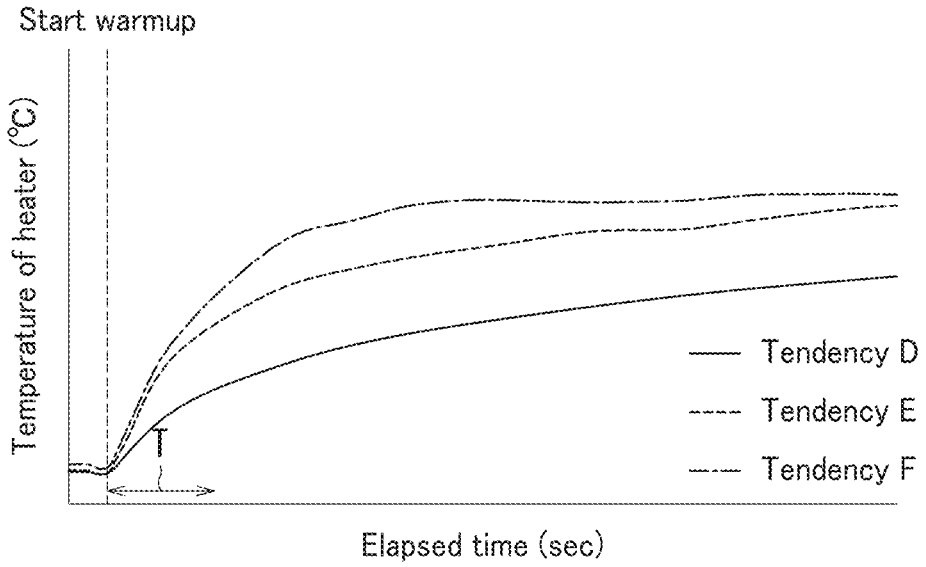
FIGS. 6A and 6B illustrate linear velocity control on the pressure roller based on temperature change of the heater after a warmup start of the fixing device.

Temperature control in the image forming apparatus 3 of the present embodiment will be described next with reference to FIGS. 4 to 6. FIG. 4 is a block diagram of elements for temperature control in the image forming apparatus 3 in the present embodiment. FIGS. 5A and 5B illustrate linear velocity control on the pressure roller 31 according to temperature change of the heater 32 of the fixing device 16 after the image forming apparatus 3 terminates a printing operation. FIGS. 6A and 6B illustrate linear velocity control on the pressure roller 31 according to temperature change of the heater 32 after the image forming apparatus 3 starts a warmup of the fixing device 16.

As illustrated in FIG. 4, the image forming apparatus 3 includes a duration measuring section 40, a temperature measuring section 41, a temperature information output section 42, a temperature tendency computing section 43, an estimating section 44, storage 45, a drive controller 46, and a pressure roller drive section 47. At least the temperature information output section 42, the temperature tendency computing section 43, the estimating section 44, and the drive controller 46 are each constituted by an application specific integrated circuit (ASIC).

The duration measuring section 40 measures a plurality of times. The temperature measuring section 41 measures a temperature of the heater 32 or the fixing belt 30 at each of the times. The temperature information output section 42 outputs heater temperature information based on the temperatures of the heater at the respective times or outputs fixing belt temperature information based on the temperatures of the fixing belt 30 at the respective times. The temperature tendency computing section 43 outputs temperature tendency information of the heater 32 based on the heater temperature information or outputs temperature tendency information of the fixing belt 30 based on the fixing belt temperature information.

The estimating section 44 estimates a temperature of the pressure roller 31 based on the temperature tendency information of the heater 32 or the fixing belt 30, and outputs pressure roller temperature information. The storage 45 stores reference tendency information therein. The drive controller 46 compares the pressure roller temperature information with the reference tendency information, and outputs linear velocity information for controlling the linear velocity of the pressure roller 31. The pressure roller drive section 47 drives the pressure roller 31 based on the linear velocity information.

The present embodiment will be schematically described below. When the pressure roller 31 is relatively hot, the pressure roller 31 may expand. Due to expansion, the radius of rotation from the non-illustrated axial center to the circumferential surface of the pressure roller 31 may increase.

When the pressure roller 31 with an increased radius of rotation is rotated, the linear velocity of the circumferential surface of the pressure roller 31 may be greater than a reference linear velocity. As such, a difference may arise between the actual linear velocity of the pressure roller 31 and the conveyance speed of the sheet S passing through the nip part N between the pressure roller 31 and the fixing belt 30 to cause failure in conveyance of the sheet S.

The pressure roller drive section 47 drives the pressure roller 31 at a linear velocity corrected to be later than the reference linear velocity based on the linear velocity information.

A specific example of temperature control on the heater 32 of the fixing device 16 by the image forming apparatus 3 will be described next with reference to FIGS. 5A and 5B. First, the duration measuring section 40 measures (times) a plurality of times and outputs time information. The duration measuring section 40 is a timer, for example.

The temperature measuring section 41 measures temperatures of the heater 32 at the respective times. The temperature measuring section 41 is disposed in the vicinity of the heater 32. Examples of the temperature measuring section 41 include a resistance temperature detector, a thermistor, a thermostat, and a thermocouple. The temperature measuring section 41 may measure temperatures of the heater 32 at regular measurement intervals at which the duration measuring section 40 measures the time. The heater temperature information is information indicating the temperatures of the heater 32.

The temperature measuring section 41 may measure temperatures of the fixing belt 30 at the respective times. In this case, the temperature measuring section 41 is disposed in the vicinity of the fixing belt 30. The temperature measuring section 41 may measure temperatures of the fixing belt 30 at regular measurement intervals at which the duration measuring section 40 measures the times. The fixing belt temperature information is information indicating the temperatures of the fixing belt 30.

The temperature information output section 42 outputs at each of the times the heater temperature information based on the temperatures of the heater 32 at the times or the fixing belt temperature information based on the temperatures of the heater 32 at the times. The heater temperature information may be a combination of the heater temperature information and time information for the heater 32. The fixing belt temperature information may be a combination of the fixing belt temperature information and time information for the fixing belt 30.

The temperature tendency computing section 43 outputs the temperature tendency information of the heater 32 based on the heater temperature information or outputs the temperature tendency information of the fixing belt 30 based on the fixing belt temperature information.

In one example, the temperature tendency computing section 43 computes temperature tendency information on a tendency A, a tendency B, and a tendency C based on detection information, as illustrated in FIGS. 5A and 5B. The temperature tendency computing section 43 acquires an average gradient of drops of the measured temperatures of the heater 32 relative to the times in the order of lapsed time based on the temperature tendency information illustrated in FIGS. 5A and 5B after fixing operation of the fixing device 16 terminates.

The estimating section 44 estimates a temperature of the pressure roller 31 as the pressure roller temperature information based on the temperature tendency information, and outputs the pressure roller temperature information. The estimating section 44 estimates a temperature of the pressure roller 31 based on the temperature tendency information per time lapse. Alternatively, the estimating section 44 may estimate a rapid drop of the temperature of the pressure roller 31 in a case of the tendency A.

The tendency A is a tendency of the temperature of the heater 32 as an example in a case in which fixing to a small number of sheets S such as one sheet S is performed after a long time has passed since the fixing device 16 has been in operation. The tendency A has an average gradient of (−20). The pressure roller 31 is sufficiently cool before being driven in this case. As such, the temperature of the pressure roller 31 rapidly drops after a drive stop thereof.

The storage 45 stores reference tendency information therein. The storage 45 may store the tendency A therein as the reference tendency information.

The drive controller 46 compares the pressure roller temperature information with the reference tendency information and outputs linear velocity information for controlling the linear velocity of the pressure roller 31. The pressure roller drive section 47 drives the pressure roller 31 based on the linear velocity information. That is, the drive controller 46 performs control based on the reference tendency information and the pressure roller temperature information so that the pressure roller 31 is driven at a preferable linear velocity. The drive controller 46 may perform control so that the linear velocity of the pressure roller 31 is a reference linear velocity (with a correction amount of 0).

In other words, the pressure roller temperature information indicates expansion of the pressure roller 31 due to temperature change. That is, the drive controller 46 can control the linear velocity of the pressure roller 31 according to expansion of the pressure roller 31 due to temperature change.

The pressure roller drive section 47 drives the pressure roller 31 at a preferable linear velocity based on the linear velocity information. The pressure roller drive section 47 may drive the pressure roller 31 at the reference linear velocity based on the linear velocity information.

The tendency B indicated in FIG. 5A is a temperature tendency of the heater 32 as an example in a case in which the fixing device 16 has been in a sleep state. As illustrated in FIG. 5B, the tendency B has an average gradient of (−15). The pressure roller 31 is relatively cool before being driven. As such, the temperature of the pressure roller 31 more gently drops after a drive stop than that in a case of the tendency A.

The estimating section 44 estimates a temperature of the pressure roller 31 per time lapse based on the temperature tendency information. The estimating section 44 estimates a gentle drop of the temperature of the pressure roller 31 in a case of the tendency B.

The drive controller 46 performs control based on the reference tendency information and the pressure roller temperature information so that the pressure roller 31 is driven at a linear velocity corrected by (−5). The pressure roller drive section 47 may drive the pressure roller 31 at a linear velocity lower by (−5) than the reference linear velocity based on the linear velocity information.

The tendency C indicated in FIG. 5A is a temperature tendency of the heater 32 as an example in a case in which the fixing device 16 has been in operation for a long time. As illustrated in FIG. 5B, the tendency C has an average gradient of (−10). The pressure roller 31 is relatively hot before being driven. As such, the temperature of the pressure roller 31 further more gently drops after a drive stop than that in cases of the tendencies A and B.

The estimating section 44 estimates a temperature of the pressure roller 31 based on the temperature tendency information per time lapse. The estimating section 44 estimates the temperature of the pressure roller 31 being relatively high in a case of the tendency C.

The drive controller 46 performs control based on the reference tendency information and the pressure roller temperature information so that the pressure roller 31 is driven at a linear velocity corrected by (−10). The pressure roller drive section 47 may drive the pressure roller 31 at a linear velocity lower by (−10) than the reference linear velocity based on the linear velocity information.

The drive controller 46 can control the linear velocity of the pressure roller 31 according to expansion of the pressure roller 31 due to temperature change in the present embodiment. Accordingly, the difference between the linear velocity of the pressure roller 31 and the conveyance speed of the sheet S passing through the nip part N between the pressure roller 31 and the fixing belt 30 can be reduced, thereby preventing production of failure in conveyance of the sheet S.

The duration measuring section 40 may measure (time) a predetermined time period T (predetermined time T) from a stop of the fixing device 16. The drive controller 46 may control the pressure roller drive section 47 to drive the pressure roller 31 based on the linear velocity information only when a restart instruction is received in the predetermined time period T starting from a stop of the fixing device 16.

According to the present embodiment, the pressure roller 31 can be driven at a preferable linear velocity by effectively utilizing the pressure roller temperature information indicating expansion of the pressure roller 31 due to temperature change.

In addition, the duration measuring section 40 may measure (time) a predetermined time period T (predetermined time T) from a stop of the fixing device 16. The drive controller 46 may invalidate the pressure roller temperature information when the restart instruction is not received in the predetermined time period T starting from a stop of the fixing device 16. In this case, the drive controller 46 may delete the pressure roller temperature information. The drive controller 46 may control the pressure roller drive section 47 so as to drive the pressure roller 31 at the reference linear velocity.

In the present embodiment, the pressure roller 31 can be driven at the reference linear velocity when the restart instruction is received after a sufficient time period elapses from a stop of the fixing device 16.

Another example of the temperature control on the heater 32 of the fixing device 16 by the image forming apparatus 3 will be described next with reference to FIGS. 6A and 6B. As illustrated in FIGS. 6A and 6B, the temperature tendency computing section 43 computes temperature tendency information on a tendency D, a tendency E, and a tendency F based on the detection information. The temperature tendency information illustrated in FIGS. 6A and 6B indicates average gradients of increases in the measured temperature of the heater 32 relative to the times in the order of elapsed time after a warmup start of the fixing device 16.

In the present embodiment, the duration measuring section 40 measures a predetermined time period T starting from a warmup start of the fixing device 16.

The tendency D is a temperature tendency of the heater 32 as an example in a case in which the fixing device 16 warms up after the fixing device 16 has not been in operation for a long time. The duration measuring section 40 measures the predetermined time period T starting from a warmup start of the fixing device 16. The tendency D has an average gradient of (+10) in the predetermined time period T. When the fixing device 16 has not been in operation for a long time, the pressure roller 31 is sufficiently cool before being driven. As such, the temperature of the pressure roller 31 gently increases after a warmup start.

The estimating section 44 estimates a temperature of the pressure roller 31 per time lapse based on the temperature tendency information. The estimating section 44 estimates a gentle increase of the temperature of the pressure roller 31 in a case of the tendency D.

The drive controller 46 performs control based on the reference tendency information and the pressure roller temperature information so that the pressure roller 31 is driven at the reference linear velocity (corrected by (0)). The pressure roller drive section 47 drives the pressure roller 31 at the reference linear velocity based on the linear velocity information.

The tendency E is a temperature tendency of the heater 32 as an example in a case in which the fixing device 16 has been in a sleep state. The tendency E has an average gradient of (+15). The pressure roller 31 is relatively hot before being driven. As such, the temperature thereof more rapidly increases after a warmup start than that in a case of the tendency D.

The estimating section 44 estimates a temperature of the pressure roller 31 based on the temperature tendency information per time lapse. The estimating section 44 estimates a rapid increase of the temperature of the pressure roller 31 in a case of the tendency E.

The drive controller 46 performs control based on the reference tendency information and the pressure roller temperature information so that the pressure roller 31 is driven at a linear velocity corrected by (−5). The pressure roller drive section 47 drives the pressure roller 31 at a linear velocity lower by (−5) than the reference linear velocity based on the linear velocity information.

The tendency F is a temperature tendency of the heater 32 as an example in a case in which the fixing device 16 warms up after the fixing device 16 has been in operation for a long time. The tendency F has an average gradient of (+20). The pressure roller 31 is relatively hot before being driven. As such, the temperature of the pressure roller 31 further more rapidly increases after a drive stop than that in cases of the tendencies D and E.

The estimating section 44 estimates a temperature of the pressure roller 31 per time lapse based on the temperature tendency information. The estimating section 44 estimates the temperature of the pressure roller 31 being relatively high in a case of the tendency F.

The drive controller 46 performs control based on the reference tendency information and the pressure roller temperature information so that the pressure roller 31 is driven at a linear velocity corrected by (−10). The pressure roller drive section 47 drives the pressure roller 31 at a linear velocity lower by (−10) than the reference linear velocity based on the linear velocity information.

In the present embodiment, the linear velocity of the pressure roller 31 can be controlled according to the state of the fixing device 16 before a warmup start. Accordingly, the difference between the linear velocity of the pressure roller 31 and the conveyance speed of the sheet S passing through the nip part N between the pressure roller 31 and the fixing belt 30 can be reduced, thereby preventing production of failure in conveyance of the sheet S.

Figure 7:
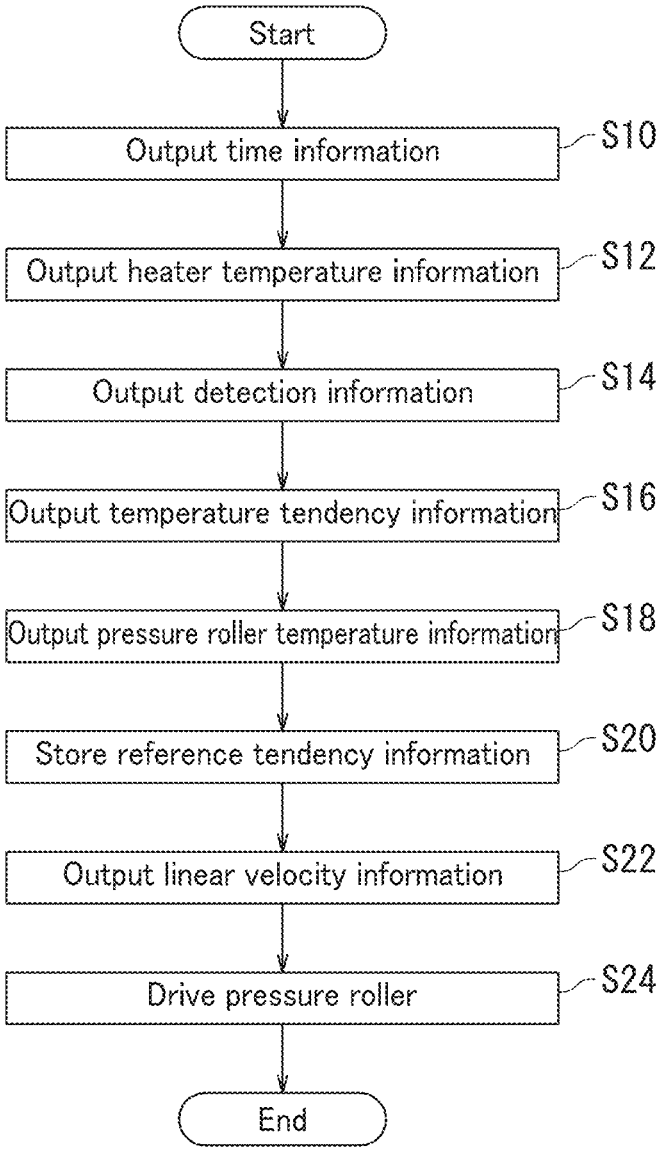
FIG. 7 is a flowchart depicting an example of temperature control in the fixing device.

The control in the image forming apparatus 3 in the present embodiment will be described next with reference to FIG. 7. FIG. 7 is a flowchart depicting the control in the image forming apparatus 3 according to the present embodiment.

As depicted in FIG. 7, the routine includes Steps S10 to S24. Specifics are as follows.

In step 10, the duration measuring section 40 measures a plurality of times. The routine proceeds to Step S12.

In Step S12, the temperature measuring section 41 measures the temperature of the heater 32 and outputs the heater temperature information, or measures the temperature of the fixing belt 30 and outputs the fixing belt temperature information. The routine proceeds to Step S14.

In Step S14, the temperature information output section 42 detects temperatures of the heater 32 at the respective times based on the heater temperature information or detects temperatures of the fixing belt 30 at the respective times based on the fixing belt temperature information, and outputs the detection information. The routine proceeds to Step S16.

In Step S16, the temperature tendency computing section 43 outputs the temperature tendency information of the heater 32 or the fixing belt 30 based on the detection information. The routine proceeds to Step S18.

In Step S18, the estimating section 44 estimates a temperature of the pressure roller 31 based on the temperature tendency information and outputs the pressure roller temperature information. The routine proceeds to Step S20.

In Step S20, the storage 45 stores the reference tendency information. The routine proceeds to Step S22.

In Step S22, the drive controller 46 compares the pressure roller temperature information with the reference tendency information and outputs the linear velocity information for controlling the linear velocity of the pressure roller 31. The routine proceeds to Step S24.

In Step S24, the pressure roller drive section 47 drives the pressure roller 31 based on the linear velocity information. The routine ends then.

Figure 8:
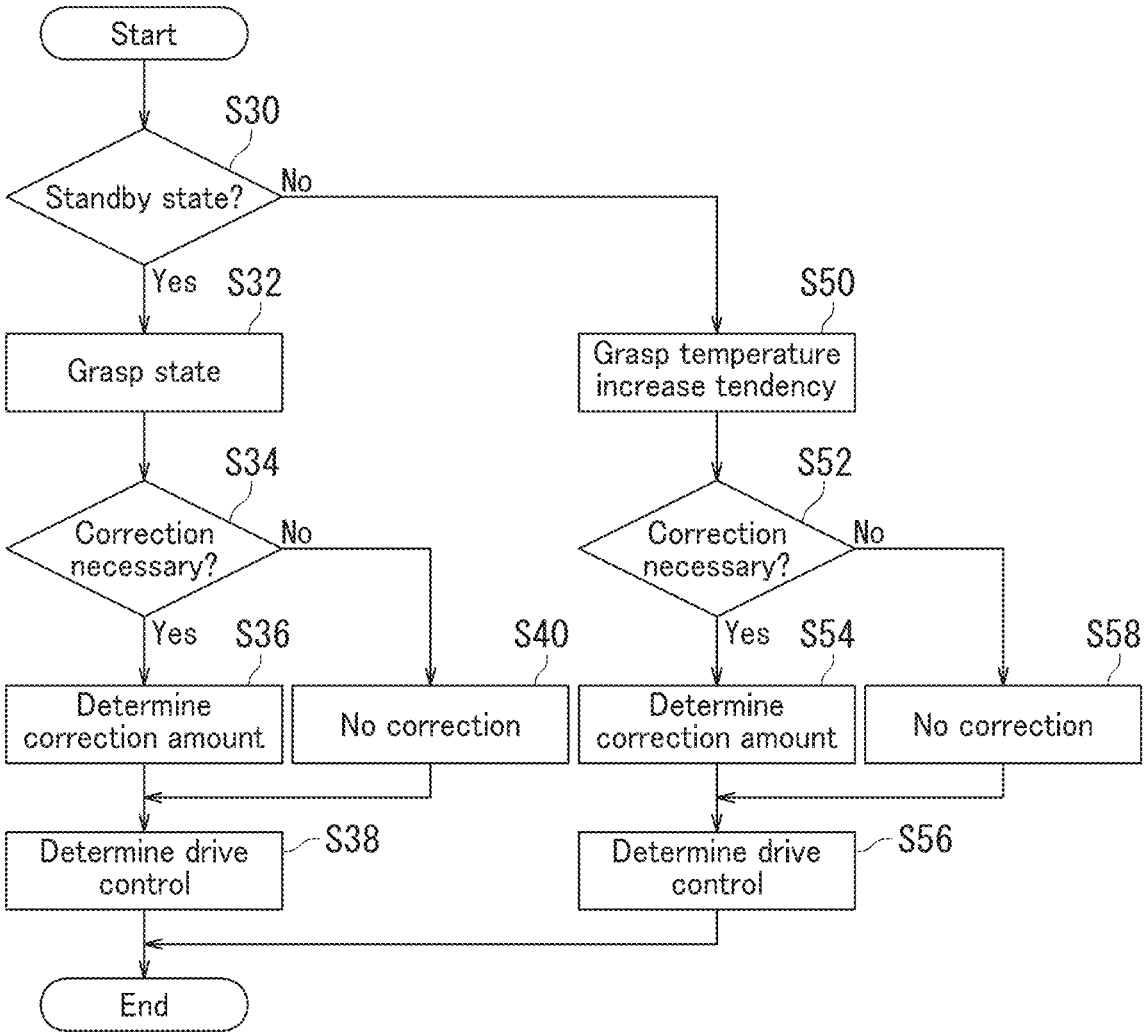
FIG. 8 is a flowchart depicting another example of the temperature control in the fixing device.

Another temperature control in the image forming apparatus 3 in the present embodiment will be described next with reference to FIG. 8. FIG. 8 is a flowchart depicting the other temperature control in the image forming apparatus 3 according to the present embodiment.

As depicted in FIG. 8, the routine includes Steps S30 to S58. Specifics are as follows.

In step S30, the printer controller 10 determines whether or not the image forming apparatus 3 is in the standby state as depicted in FIG. 8. If it is determined that the image forming apparatus 3 is in the standby state (Yes in Step S30), the routine proceeds to Step S32. If it is determined that the image forming apparatus 3 is not in the standby state (No in Step S30), the routine proceeds to Step S50.

In step S32, the printer controller 10 grasps the state of the image forming apparatus 3. The routine proceeds to Step S34.

In Step S34, the drive controller 46 determines whether or not it is necessary to correct the temperature of the pressure roller 31. If it is determined that it is necessary to correct the temperature of the pressure roller 31, the routine proceeds to Step S36. If it is determined that it is not necessary to correct the temperature of the pressure roller 31, the routine proceeds to Step S40.

If an affirmative determination is made in Step S34, the drive controller 46 determines a correction amount for correcting the temperature of the pressure roller 31 in Step S36. The routine proceeds to Step S38.

In step S38, the drive controller 46 determines control at a corrected temperature on the pressure roller 31. The routine ends then.

If a negative determination is made in Step S34, the drive controller 46 determines not to correct the temperature of the pressure roller 31 in Step S36.

If a negative determination is made in Step S30, the temperature tendency computing section 43 grasps a temperature increase tendency of the pressure roller 31 in Step S50. The routine proceeds to Step S52.

In Step S52, the drive controller 46 determines whether or not it is necessary to correct the temperature of the pressure roller 31. If it is determined that it is necessary to correct the temperature of the pressure roller 31, the routine proceeds to Step S54. If it is determined that it is not necessary to correct the temperature of the pressure roller 31, the routine proceeds to Step S58.

If an affirmative determination is made in Step S52, the drive controller 46 determines a correction amount for correcting the temperature of the pressure roller 31 in Step S54. The routine proceeds to Step S56.

In step S56, the drive controller 46 determines control to drive the pressure roller 31 at the corrected temperature. The routine ends then.

If a negative determination is made in Step S52, the drive controller 46 determines not to correct the temperature of the pressure roller 31.

An embodiment of the present disclosure has been described so far with reference to the drawings. However, the present disclosure is not limited to the above embodiment and may be implemented in various different forms that do not deviate from the essence of the present disclosure. The drawings schematically illustrate elements of configuration in order to facilitate understanding, and properties of elements of configuration illustrated in the drawings, such as thickness, length, and number thereof, may differ from actual properties thereof in order to facilitate preparation of the drawings. Furthermore, properties of elements of configuration described in the above embodiment, such as material, shape, and dimensions, are merely examples and are not intended as specific limitations. Various alterations may be made so long as there is no substantial deviation from the effects of the present disclosure.

What is claimed is:

1. An image forming apparatus comprising a fixing device, wherein the fixing device includes:

a fixing belt configured to heat a toner image transferred to a sheet to fix the toner image to the sheet;

a heater configured to heat the fixing belt; and a pressure roller configured to rotate the fixing belt while in contact with the fixing belt, the image forming apparatus further comprises:

a duration measuring section configured to measure a plurality of times;

a temperature measuring section configured to measure a temperature of the heater at each of the times or measure a temperature of the fixing belt at each of the times;

a temperature information output section configured to output heater temperature information based on the temperatures of the heater at the respective times or output fixing belt temperature information based on the temperatures of the fixing belt at the respective times;

a temperature tendency computing section configured to output temperature tendency information of the heater based on the heater temperature information or output temperature tendency information of the fixing belt based on the fixing belt temperature information;

a drive controller configured to output linear velocity information for controlling a linear velocity of the pressure roller based on the temperature tendency information of the heater or the temperature tendency information of the fixing belt; and a pressure roller drive section configured to drive the pressure roller based on the linear velocity information.

2. An image forming apparatus according to claim 1, wherein the duration measuring section measures a predetermined time period starting from a stop of the fixing device, and only when a restart instruction is received in the predetermined time period, the drive controller controls the pressure roller drive section to drive the pressure roller based on the linear velocity information.

3. The image forming apparatus according to claim 1, wherein the duration measuring section measures a predetermined time period starting from a stop of the fixing device, and when a restart instruction is not received in the predetermined time period starting from the stop of the fixing device, the drive controller invalidates the pressure roller temperature information.

4. The image forming apparatus according to claim 1, wherein the duration measuring section measures a predetermined time period starting from a warmup start of the fixing device.

* * * * *